United States Patent [19]

Swett et al.

[11] Patent Number: 4,523,757

[45] Date of Patent: Jun. 18, 1985

[54] BOWLING BALL WEIGHT EXCHANGER

[76] Inventors: Robert C. Swett; Richard E. Swett, both of 1074 Strong St., Schenectady, N.Y. 12307

[21] Appl. No.: 499,372

[22] Filed: May 31, 1983

[51] Int. Cl.[3] ..... A63B 37/10

[52] U.S. Cl. ..... 273/63 E; 273/DIG. 20

[58] Field of Search ..... 273/63 E, 171, 63 R, 273/63 B, 63 D, 63 G, 65 EC; 40/327

[56] References Cited

U.S. PATENT DOCUMENTS

| | | | |
|---|---|---|---|
| 1,026,069 | 5/1912 | Berdelari . | |
| 1,133,129 | 3/1915 | Govan | 273/171 |
| 3,039,774 | 2/1960 | Gerlach | 273/63 |
| 3,441,274 | 4/1969 | Collins | 273/63 E |
| 3,591,177 | 7/1971 | Skuse | 273/63 |

*Primary Examiner*—George J. Marlo

*Attorney, Agent, or Firm*—Heslin, Watts & Rothenberg

[57] ABSTRACT

A bowling ball which has six weight receptacles arranged such that one receptacle is at the intersection of each of the mutually perpendicular X, Y, Z axes emanating from the center of the ball and the outer surface of the ball. A poly-vinyl-chloride cylinder lines each of the receptacles and inserts of predetermined weight can be inserted in various combinations into the receptacles. The weight receptacles are positioned in the ball such that one of the receptacles lies substantially equidistant from the finger holes of the bowling ball.

5 Claims, 3 Drawing Figures

BOWLING BALL WEIGHT EXCHANGER

FIELD OF THE INVENTION

This invention relates to the sport of bowling, and more specifically to bowling balls which are adapted to receive weighted inserts.

BACKGROUND AND SUMMARY OF THE INVENTION

Over the years, the sport of bowling has been enjoyed by those exhibiting various degrees of skill. In fact, it often seems that the game is enjoyed equally as well by the novice as the professional. While the professional or more serious bowler is more aware of the variables which effect the game, the goals shared by all of these individuals is to improve their game score.

When seeking to improve ones game, the most commonly altered piece of equipment is, of course, the bowling ball. A sample of the choices which the bowler must make include whether or not the ball should be made of plastic, urethane or rubber, whether the grip should be drilled with deep finger holes or for a finger tip grip, and of course, one must also choose the weight of the ball which generally ranges from 8 to 16 lbs. Another variable which was noted in the early years of bowling was that the weight removed from the ball when drilling the finger holes affected the movement of the ball. This has led some bowlers to add weights near the finger holes in order to offset the loss due to drilling while others have added weights in specific locations in order to cause an imbalance and thereby alter the movement of the ball.

While we were studying the various effects produced by different weight distributions, a number of professional bowlers were questioned concerning their experiences. Quite surprisingly, we found their answers to be significantly different from one another. The reason for this discrepancy appears to be twofold. First, the effect of a weight imbalance will depend somewhat upon the degree of lift as well as the ball's direction during delivery which varies from bowler to bowler. Secondly, since there has not been a suitably effective way to test the various bowling ball weight combinations, conclusions as to the various effects of weight imbalances are often based upon an inadequate amount of data.

Prior to this invention, one wishing to test various weight imbalances either had to have his bowling ball drilled and replugged with different weights, or else purchase a large number of bowling balls and have each one drilled and weighted separately. The first option was found to be impractical because it required too much time which prevented accurate comparisons of the various weight imbalances under the same conditions. The latter solution was also found to be impractical due to the cost of purchasing the large number of bowling balls that were required even if one were only to test the most basic weight variations.

For these reasons, it was an object of this invention to develop a bowling ball which could be used to experiment with a variety of weight combinations.

Another object of this invention was to provide a bowling ball with multiple weight distributions which was inexpensive to manufacture and easy to use.

Briefly described, the present invention is a bowling ball which contains a plurality of weight receptacles. If one were to imagine mutually perpendicular X, Y, and Z axes emanating from the center of the ball, then there would be a weight receptacle placed at the intersection of each axis and the external surface of the ball. Each receptacle is internally threaded to receive an insert of predetermined weight.

Also briefly described, the present invention is a method for manufacturing a bowling ball which is adapted to receive a plurality of weights in order to vary the balance of the ball. The first step involves drilling a number of weight receptacles. These receptacles are placed at the intersection of the ball's surface and the X, Y, or Z axes emanating from the center of the ball. The receptacle is then lined with an internally threaded cylinder and inserts of predetermined weight are placed therein.

Also briefly described, the present invention is a kit for modifying a standard bowling ball to receive a plurality of weighted inserts. The kit consists of a plurality of threaded weights and a number of weight cylinders made of poly-vinyl-chloride to be positioned in the weight receptacles which are drilled in the ball.

DETAILED DESCRIPTION OF THE DRAWINGS

Figure 1:
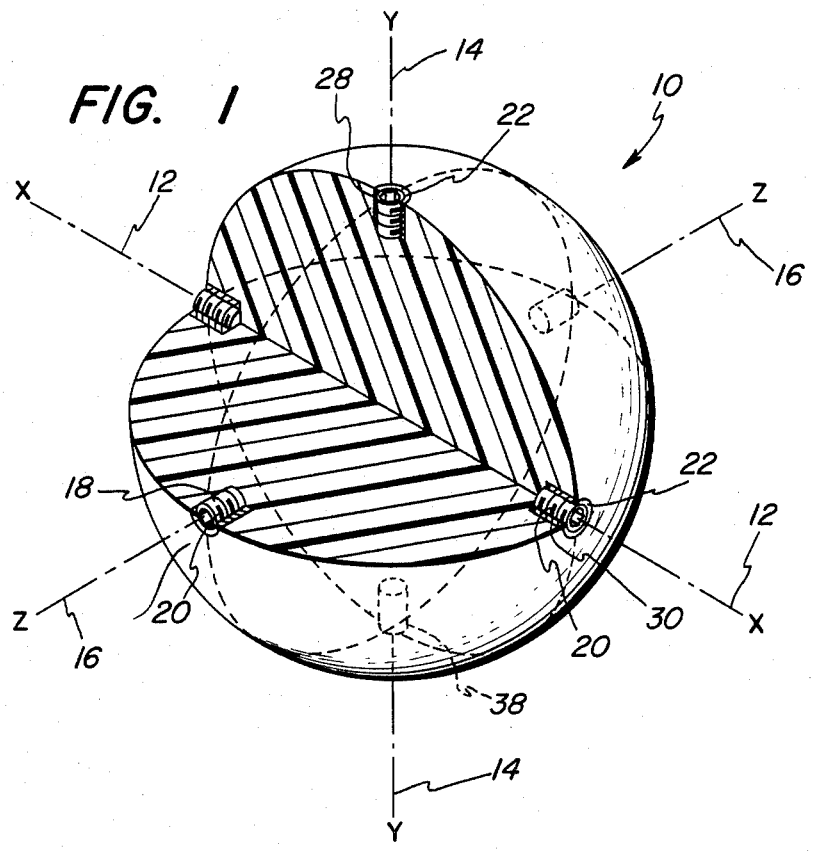
FIG. 1 is a perspective view of a bowling ball with one of the quadrants removed, showing X, Y and Z axes emanating from the center of the ball.

FIG. 1 discloses the bowling ball generally designated as 10. Imaginary axes X, Y and Z which are numbered 12, 14 and 16 respectively are mutually perpendicular and extend outwardly from the bowling ball. If said axes were extended inwardly, they would all intersect at the center of the ball. A weight receptacle is drilled into the ball at the intersection of each of these axes and the outer surface of the ball. In my preferred embodiment, each receptacle is one inch in diameter and one and one-sixteenth inches deep.

Figure 3:
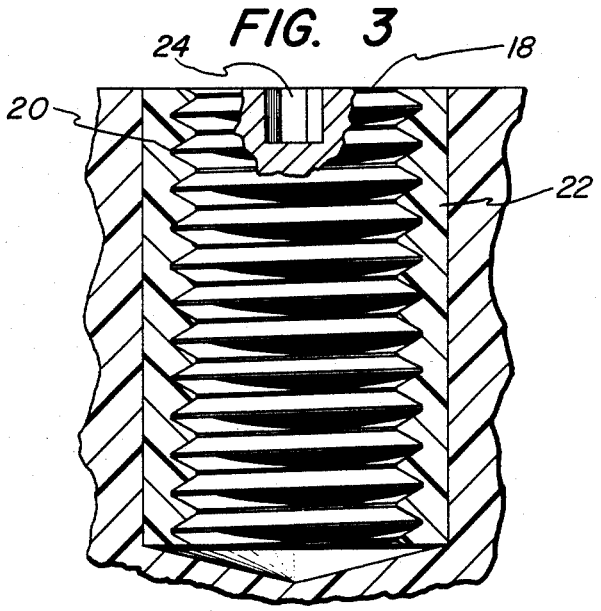
FIG. 3 is an enlarged view showing the weighted insert, weight receptacle and cylinder.

FIG. 3 is an enlargement of one of the weight receptacles with its cylinder 22 and weighted insert. In the preferred embodiment, the cylinder 22 is made of poly-vinyl-chloride which is glued as a lining into the weight receptacle. The cylinder 22 is internally threaded to receive the threaded insert as at 20. As shown at the top of FIG. 3 where a portion of the insert is broken away, each insert has a hexagonal opening 24 at its top end for easy insertion and removal. Generally, these inserts are provided at weights of ½ ounce and 1 ounce. With the different weights and the number of receptacles in the ball for placing the inserts, a bowler has available to him numerous combinations which can easily be changed to meet his particular style or the alley conditions upon which he is bowling.

Figure 2:
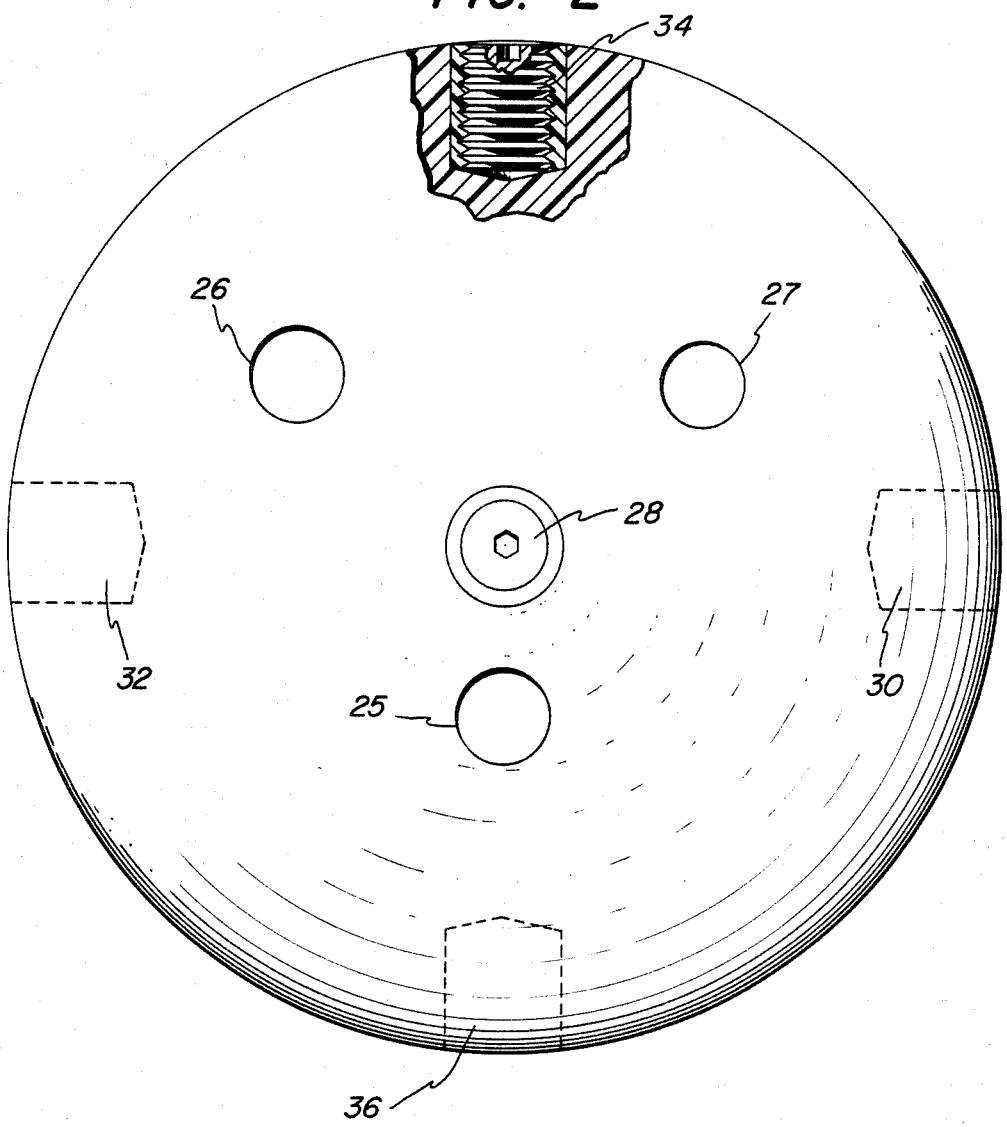
FIG. 2 is a top view of the bowling ball disclosing the placement of the weight receptacles, with regard to the finger holes of the bowling ball.

FIG. 2 discloses the location of the various weight receptacles with regard to the finger holes of the bowling ball. The positioning of the finger holes and effect of the weights will be described for a bowling ball used by a right-handed bowler. As can be seen from FIG. 2, the top weight 28 is substantially equidistant from the thumb hole 25, middle finger hole 26 and ring finger hole 27. The insertion of this top weight 28 tends to affect the bowling ball in such a way that the ball begins revolving earlier as it moves down the alley. Conversely, the weight at the bottom of the ball opposite the top weight 28 is the bottom weight 38, as shown in FIG. 1, which tends to cause the ball to begin revolving later, such that the ball slides further down the alley. The weight to the right of the top weight 28 as one looks at FIG. 2 is called the positive side weight 30. Use of this weight will tend to cause the ball to move further down the alley before it starts to hook inwardly toward the pins. The weight to the left of the top weight 28 is the negative side weight 32 which tends to cause the ball to hook towards the pins earlier as it moves down the alley.

At the top of FIG. 2 is the finger weight 34. This finger weight 34 inhibits the rolling of the ball so that it starts rolling further down the alley and hits into the pins with a greater impact. Conversely, at the bottom of FIG. 2 is the thumb weight 36 which tends to cause the ball to roll sooner, thereby resulting in its hitting into the pins with a lighter impact.

With all the possible combinations of inserting one-half and one ounce weights, it is evident that the bowler has available to him a large variety of alternatives. By testing the various weight combinations, he can more accurately find those weight imbalances which are most suited to his bowling style or best for a specific alley condition.

In order to convert one's own bowling ball into the weight exchanger, one would only need a kit containing six one-half ounce inserts and six one ounce inserts which are externally threaded, six poly-vinyl-chloride weight cylinders, a device for inserting and removing the weights and means such as glue for fastening the cylinders within the weight receptacles. The receptacles would then need to be drilled at the previously described locations.

It will be appreciated by those familiar with the art that the above described invention is the preferred embodiment and that various changes can be made without departing from the intent of this invention which is intended only to be limited by the appended claims.

What is claimed:

1. An improved bowling ball for use in determining the most beneficial internal ball weight distributions for a particular bowler's style comprising:

a bowling ball having mutually perpendicular x, y and z axes emanating outwardly from the center of the ball; and at least six weight receptables, one at each of the intersections of said axes and the exterior surface of the bowling ball, each receptable containing an internally threaded cylinder secured to the inner surface of the receptacle and adapted to receive an insert of predetermined weight for creating various weight imbalances within the ball.

2. The invention of claim 1 wherein the ball has a plurality of finger holes and wherein one of the receptacles is located between the finger holes and is substantially equidistant from each of said holes.

3. The invention of claim 2 wherein each receptacle is one inch in diameter and one and one-sixteenth inches deep.

4. The invention of claim 3 wherein the cylinder is made of poly-vinyl-chloride.

5. A method for manufacturing a bowling ball which can be altered so as to have varying internal weight distributions comprising the following steps:

drilling a plurality of weight receptacles into the ball, at least one receptacle being at each of the intersections of mutually perpendicular X, Y and Z axes emanating from the center of the ball, and the outer surface of the ball;

lining each receptacle with a reinforcing internally threaded cylinder; and securing each cylinder to the inner surface of its receptacle.

* * * * *